United States Patent [19]

Keiter et al.

[11] Patent Number: 4,820,125

[45] Date of Patent: Apr. 11, 1989

[54] RIBBON DEVICE FOR TYPEWRITERS OR SIMILAR OFFICE MACHINES

[75] Inventors: Alfred Keiter; Manfred Sauer, both of Wilhelmshaven, Fed. Rep. of Germany

[73] Assignee: AEG Olympia AG, Wilhelmshaven, Fed. Rep. of Germany

[21] Appl. No.: 142,977

[22] Filed: Jan. 12, 1988

[30] Foreign Application Priority Data

Jan. 12, 1987 [DE] Fed. Rep. of Germany ..... 3700636

[51] Int. Cl.[4] ..... B41J 35/36

[52] U.S. Cl. ..... 400/249; 400/702.1; 250/239

[58] Field of Search ..... 250/239; 400/126, 120, 400/249, 247, 701, 702, 702.1

[56] References Cited

U.S. PATENT DOCUMENTS

| | | | |
|---|---|---|---|
| 4,401,394 | 8/1983 | Hume et al. | 400/249 |
| 4,450,454 | 5/1984 | Koto | 400/126 |
| 4,479,730 | 10/1984 | Yoshioka et al. | 400/249 |
| 4,638,154 | 1/1987 | Itsuki et al. | 250/239 |

FOREIGN PATENT DOCUMENTS

| | | | |
|---|---|---|---|
| 3607228 | 9/1987 | Fed. Rep. of Germany | 400/701 |
| 55781 | 3/1984 | Japan | 400/702 |
| 199279 | 11/1984 | Japan | 400/247 |
| 92871 | 5/1985 | Japan | 400/249 |
| 121985 | 6/1986 | Japan | 400/249 |
| 146587 | 7/1986 | Japan | 400/249 |

OTHER PUBLICATIONS

"Bristle Brushes . . . Point Band", IBM Technical Disclosure Bulletin, vol. 29, No. 6, p. 2759, 11-86.

*Primary Examiner*—William Pieprz

*Attorney, Agent, or Firm*—Spencer & Frank

[57] ABSTRACT

An end-of-ribbon sensing device for an office machine, which machine includes a printing station for receiving a nonreusable ribbon which is displaceable through the printing station and which has a scannable marking at its trailing end. The device includes: a receiving member mounted at the printing station for receiving the replaceable member; a ribbon scanning unit carried by the receiving member and having scanning elements for scanning the scannable marking disposed at the end of the ribbon and for generating a signal upon scanning of the scannable marking; a control circuit connected to the scanning unit for processing the signal generated by the scanning unit so as to generate a ribbon end signal; a covering element for selectively covering the scanning elements: and a support member supporting the covering element and carried by the receiving member, the support member being maintained in a first position, when a replaceable member is not present at the receiving member, in which the covering element covers the scanning elements, and the support member being movable in response to reception of a replaceable member by the receiving member into a second position in which the covering element is displaced so as to expose the scanning elements to the ribbon, the support member being returned to the first position upon removal of a replaceable member and the covering element being constructed for cleaning the scanning elements during return of the support member from the second position to the first position.

10 Claims, 1 Drawing Sheet

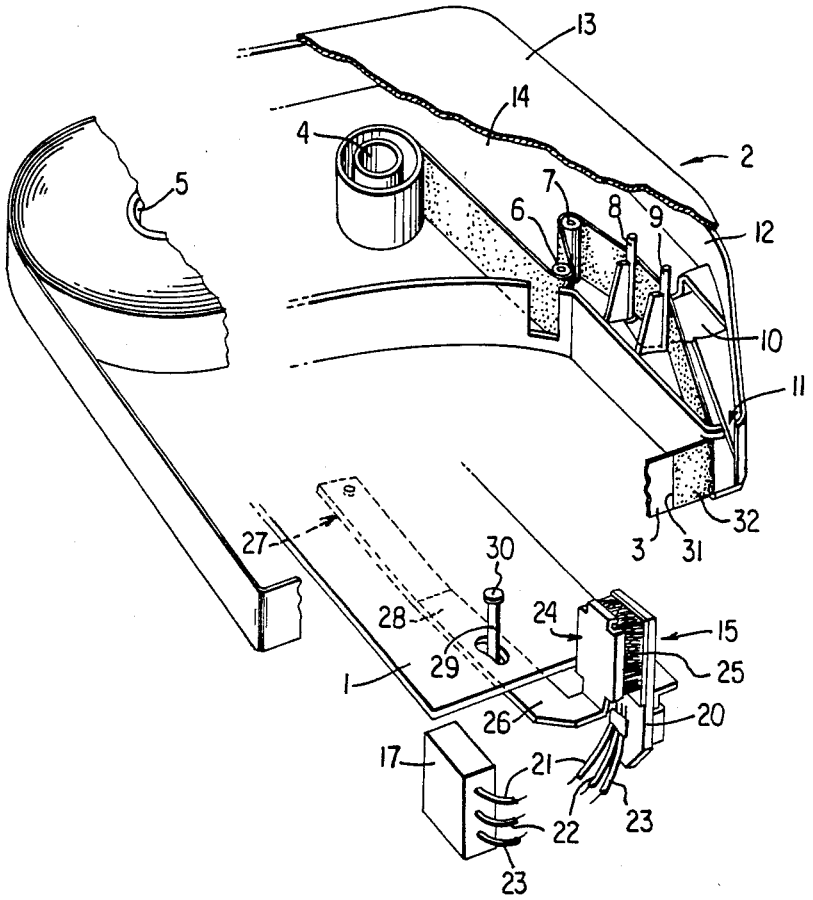
FIG. 1
FIG. 2
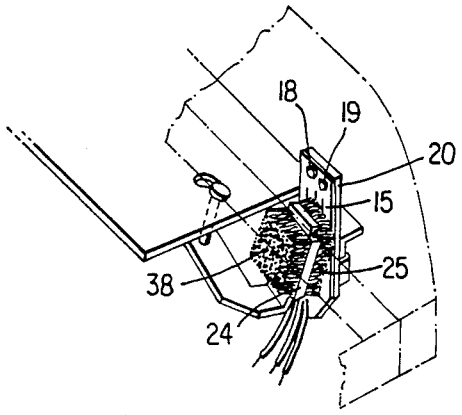
FIG. 3
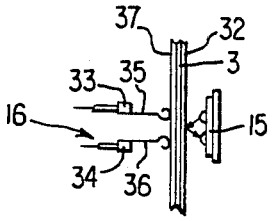

RIBBON DEVICE FOR TYPEWRITERS OR SIMILAR OFFICE MACHINES

BACKGROUND OF THE INVENTION

The present invention relates to a ribbon device for typewriters or similar office machines of the type including a single-use ribbon disposed in a cassette and moved by a driving device through a printing station while being unwound from a supply reel and wound onto a takeup reel, the device further including a scanning device disposed on a receiving device for the ribbon reels or for the ribbon cassette, respectively, in the machine, for scanning scannable markings disposed at the end of the ribbon, and a control circuit for processing the received signals generated by the scanning device so as to generate a ribbon end signal U.S. Pat. No. 4,115,013 discloses a ribbon device in which one end of the ribbon is provided with a light reflecting marked surface which is scanned by an optical scanner for processing received signals which actuate a ribbon end signal. Although the ribbon end alarm is here generated without contact, switching reliability will no longer be ensured if the transmitting and/or receiving surfaces of the optical scanner are soiled.

Soiling of the optical scanner may result in the end of the ribbon not being indicated to the machine operator. The consequence of this may be that key strokes repeatedly hit the same place on the ribbon. The production of a clean printed image is interfered with so that the entire typing process must be begun anew.

U.S. Pat. No. 4,212,552 also discloses a scanning device for ribbon end markers, but here, too, no coverage and cleaning of the scanner is disclosed.

SUMMARY OF THE INVENTION

It is an object of the present invention to provide a novel configuration for a ribbon device of the above type so that the switching reliability for the ribbon end alarm is increased.

The above and other objects are achieved, according to the present invention, by a novel end-of-ribbon sensing device for a typewriter or similar office machine, which machine includes a printing station for receiving a replaceable member provided with a supply reel, a takeup reel and a nonreusable ribbon extending between the reels, and means for advancing the ribbon through the printing station while the ribbon is being unwound from the supply reel and wound onto the takeup reel, the ribbon having a scannable marking at its trailing end, the device comprising: receiving means mounted at the printing station for receiving the replaceable member; ribbon scanning means carried by the receiving means and having scanning elements which are exposed to the ribbon when the ribbon is received by the receiving means for scanning the scannable marking disposed at the end of the ribbon and for generating a signal upon scanning of the scannable marking; a control circuit connected to the scanning means for processing the signal generated by the scanning means so as to generate a ribbon end signal; a covering element for selectively covering the scanning elements of the scanning means; and support means supporting the covering element and carried by the receiving means, the support means being maintained in a first position, when a replaceable member is not present at the receiving means, in which the covering element covers the scanning elements, and the support means being movable in response to reception of a replaceable member by the receiving means, and under control of the replaceable member, into a second position in which the covering element is displaced so as to expose the scanning elements to the ribbon and its scannable marking, the support means being operative to return to the first position upon removal of a replaceable member and the covering element being constructed for effecting cleaning action on the scanning elements during return of the support means from the second position to the first position.

The ribbon device according to the invention includes a monitoring device for the ribbon with which the end of the ribbon is reliably reported and good utilization of the ribbon is always ensured. Soiling of the switching elements by dust from the ribbon carrier, paper and the environment is eliminated in the simplest manner, thus considerably increasing switching reliability.

According to preferred embodiments of the invention, for effecting the cleaning action, the covering element is composed of a covering member made of a scouring material and having a black coloration for contacting the scanning elements. This arrangement prevents an erroneous alarm being given du to the incidence of extraneous light. Coverage by a brush or other stripping means indicates, in a removed ribbon cassette, that the machine is ready for typing and operation. This is necessary, for example, for the production of stencils.

In further accordance with the invention, the ribbon scanning means include a contact-free operating optical scanner disposed to scan a reflecting coating on one side of the ribbon and an electrical scanner which is disposed to directly contact a conductive coating on the opposite side of the ribbon. Such an arrangement is thus usable in machines employing optical scanners as well as in machines employing an electrically controlled scanner.

Other advantageous features of the invention will be described below in connection with the description of preferred embodiments presented with reference to the drawing figures.

BRIEF DESCRIPTION OF THE DRAWING

FIG. 1 is a pictorial, perspective representation of the essential parts of a ribbon device according to the invention, with the ribbon cassette removed.

FIG. 2 is a detail view of the a part of the arrangement of FIG. 1 showing the scanner in operating position.

FIG. 3 is a schematic top view of the ribbon end and the scanning devices in the embodiment of FIGS. 1 and 2.

DESCRIPTION OF THE PREFERRED EMBODIMENTS

FIG. 1 shows a receptacle for a ribbon device for typewriters or similar office machines including, in particular, a ribbon 3 for one-time, or single, use disposed in a ribbon cassette 2. A driving device moves ribbon 3 through a printing station and, in particular, unwinds it from a supply reel 4 and rewinds it onto a takeup reel 5. Coming from supply reel 4, ribbon 3 is guided around guide rollers 6 and 7 and then slides over two spaced guide pins 8 and 9 to an exit opening 11 in ribbon cassette 2. After leaving exit opening 11, ribbon 3 travels through the printing location of the printing station. Then, ribbon 3 passes through a further exit opening (not shown), and over further guide pins (also not shown) to takeup reel 5.

This ribbon cassette 2 is composed of a cup-shaped bottom member 12 and a cover 13. The two guide pins 8 and 9 are disposed on the bottom 14 of bottom member 12 on both sides of a recess 10 in bottom 14.

If ribbon cassette 2 is placed onto receiving device 1, scanning elements belonging to scanning devices 15 and 16 for scanning ribbon 3 project into the cassette through recess 10 in bottom 14 in such a manner that the end of the ribbon is reliably indicated to the machine operator by means of a control circuit 17.

Scanning device 15 is an optical scanner including, as shown in FIG. 2, a light transmitter 18 and a light receiver 19 and is fastened to an upright arm 20 in receiving device 1. Moreover, receiving device 1 is provided with a movably disposed covering element for the scanning elements of the scanning devices. Due to the specific configuration of the ribbon reels or the ribbon cassette 2, respectively, this covering element can be moved into a position exposing the scanning elements of the scanning devices to scan the markings at the end of the ribbon when the ribbon reels or, more precisely, the ribbon cassette 2, is placed onto receiving device 1 in the machine. When the ribbon reels or the ribbon cassette 2, respectively, is removed, the covering element is moved back into a position where it covers the scanning elements of the scanning devices.

Thus, according to FIGS. 1 and 2, the light transmitter 18 and the light receiver 19 of the optical scanner 15 can be covered and cleaned by covering element 24. On its side cooperating with the light transmitter 18 and the light receiver 19, covering element 24 is provided with a stripping, or scouring, material. This stripping material of the covering surface has a black coloration such that the machine, when the ribbon cassette 2 is removed from receiving device 1, is able to type and operate, for example, to inscribe stencils.

According to FIGS. 1 and 2, the stripping material of covering element 24 is composed of a black brush 25. In FIG. 1, covering element 24 is in the covering position of optical scanner 15, with ribbon cassette 2 being removed from receiving device 1. Covering element 24 is disposed at the free end 26 of a leaf spring 28 whose other end 27 is fixed to receiving device 1. Leaf spring 28 includes an upright pin 29 equipped with an abutment head 30 which will be displaced downwardly by bottom 14 of bottom member 12 of ribbon cassette 2 when cassette 2 is inserted onto receiving device 1.

When ribbon cassette 2 is placed onto receiving device 1, the bottom 14 of ribbon cassette 2 comes into contact with the abutment head 30 of pin 29 in such a manner that leaf spring 28 and covering element 24 are pivoted downwardly, i.e. essentially clockwise with respect to the direction of the view of FIG. 1. As shown in FIG. 2, this causes the brush 25 of covering element 24 to move out of engagement with the light transmitter 18 and the light receiver 19 of scanner 15. During this placement of ribbon cassette 2 onto receiving device 1, the light transmitter 18 and the light receiver 19 of optical device 15 pass through recess 10 in bottom 14 and are placed in operating position in front of ribbon 3.

At the beginning of the process of unwinding ribbon 3 from supply reel 4, the black ink coating of ribbon 3 passes the light transmitter 18 and the light receiver 19 of optical device 15 without contact. Since the light transmitted by light transmitter 18 of optical scanner 15 is not reflected by the black coating on ribbon 3, optical receiver 19 does not receive any light. In this case, no control signal is sent to control circuit 17.

On the side of its ink coating 31, the trailing end of ribbon 2 is provided with a light reflecting layer 32 as a marked surface. When this light reflecting layer 32 comes into the range of optical scanner 15, optical receiver 19 receives, by reflection from layer 32, the light transmitted by optical transmitter 18. This causes a control pulse to be sent via lines 21, 22 and 23 to control circuit 17 to then generate received signals for the generation of a ribbon end signal. The end of the ribbon may be indicated to the machine operator by an optical or an acoustic signal. It is also possible for the control circuit to make the machine inoperable when an end-of-ribbon signal is received. It will be appreciated that control circuit 17 can be designed according to principles well-known in the electronics art to produce a suitable signal.

When ribbon cassette 2 is removed from receiving device 1, brush 25 of covering element 24 brushes over light transmitting surface 18 and light receiving surface 19 of optical device 15 and passes into the covering position shown in FIG. 1. This covering of the optical device prevents soiling of the surface of the light transmitter 18 and the surface of the light receiver 19 when ribbon cassette 2 is removed. Moreover, the up and down movement of brush 25 together with covering element 24 removes dust particles from the surfaces of the light transmitter 18 and the light receiver 19 of optical device 15, thus reliably preventing the end of the ribbon from being indicated too late.

Covering element 24 has a further brush 38 which can be brought into operative connection with another electrically controlled scanning device shown in FIG. 2. For example, FIG. 3 shows an electrical scanner 16 whose contact pins 33 and 34 are provided with resilient contact lugs 35 and 36, respectively, which scan an electrically conductive layer 37 on ribbon 3. When the ribbon is removed from receiving device 1, these resilient contact lugs 35, 36 may be covered by brushes 38 of covering element 24 and thus cleaned. Since ribbon 3, according to FIG. 3, is provided at its trailing end with a light reflecting coating 32 on its ink coated side 31 with an electrically conductive layer 37 on its rear side opposite the color coated side 31, it is possible for the ribbon end to be indicated by means of optical scanner 15 operating without contact as well as by electrical scanner 16 which is in direct contact with ribbon 3. Therefore, the ribbon cassette can, according to the invention, be selectively used in typewriters equipped with optical or electrical scanning devices.

The invention now being fully described, it will be apparent to one of ordinary skill in the art that many changes and modifications can be made thereto without departing from the spirit or scope of the invention as set forth herein.

What is claimed:

1. An end-of-ribbon sensing device for an office machine, which machine includes a printing station for receiving a replaceable member provided with a supply reel, a take-up reel and a nonreusable ribbon extending between the reels, and means for advancing the ribbon through the printing station while the ribbon is being unwound from the supply reel and wound onto the take-up reel, the ribbon having a scannable marking at its trailing end, the scannable marking has a light reflecting surface, said device comprising: receiving means mounted at the printing station for receiving the replaceable member; ribbon scanning means carried by said receiving means and having scanning elements which are exposed to the ribbon when the ribbon is received by said receiving means for scanning the scannable marking disposed at the end of the ribbon and for generating a signal upon scanning of the scannable marking, said ribbon scanning means comprise an optical scanner arranged to cooperate with the light reflecting surface to indicate the ribbon end, said scanning elements include a light transmitter having a light transmitting surface and a light receiver having a light receiving surface; a control circuit connected to said scanning means for processing the signal generated by said scanning means so as to generate a ribbon end signal; a covering element for selectively covering and cleaning said scanning elements of said scanning means, said covering element comprising a scouring material; and support means supporting said covering element and carried by said receiving means, said support means being maintained in a first position, when a replaceable member is not present at said receiving means, in which said covering element covers said scanning elements, and said support means being movable in response to reception of a replaceable member by said receiving means, and under control of the replaceable member, into a second position in which said covering element is displaced so as to expose said scanning elements to the ribbon and its scannable marking, said support means being operative to return to said first position upon removal of a replaceable member and said covering element preventing transmission of light to said optical scanner when said support means is in said first position, thereby preventing generation of a ribbon end signal and permitting the machine to remain operational to perform functions not requiring a ribbon, and said scouring material of said covering element effecting a cleaning action on said scanning elements during return of said support means from said second position to said first position, said covering element being operative for covering, contacting and effecting the cleaning action on said light transmitting and light receiving surfaces.

2. Device as defined in claim 1 wherein said covering element has a black coloration.

3. Device as defined in claim 1 wherein said covering element is composed of a black brush.

4. Device as defined in claim 1 in combination with a said replaceable member in the form of a ribbon cassette having two spaced guide channels through which said ribbon is guided from said supply reel, through the printing station and to said takeup reel when said replaceable member is received at the printing station, wherein said ribbon cassette comprises a cup-shaped bottom member having a bottom provided with a recess for permitting passage of said scanning elements of said ribbon scanning means into said cassette to be in scanning position relative to said ribbon when said cassette is received by said receiving means.

5. Device as defined in claim 1 wherein the replaceable member in the form of a ribbon cassette which includes a cup-shaped bottom member having a bottom, and said support means comprise: a leaf spring having a first end secured to said receiving means and a second end which is movable relative to said receiving means and which carries said covering element; and an upright pin carried by said leaf spring and equipped with an abutment head engageable with the bottom of the bottom member of the ribbon cassette in order to pivot said support means into said second position when the cassette is received by said receiving means.

6. Device as defined in claim 1 wherein said receiving means comprise an upright arm to which said scanning elements are fixed, said scouring material of said covering element is a brush, and said support means are operative for pivotally moving said covering element between said first and second positions.

7. Device as defined in claim 1 in combination with a said replaceable member, and wherein said ribbon is coated on one side with a printing substance, the light reflecting layer is on said one side of said ribbon, and said ribbon is further provided, at its trailing end, with an electrically conductive layer on the side opposite said one side such that the ribbon end can be detected optically or electrically.

8. Device as defined in claim 7 wherein said ribbon scanning means comprise a contact-free operating optical scanner disposed to scan said one side of said ribbon.

9. Device as defined in claim 8 wherein said scanning means further comprise an electrical scanner which is disposed to directly contact said ribbon side which is opposite said one side.

10. Device as defined in claim 7 wherein said replaceable member comprises a cassette which includes a cup-shaped bottom member having a bottom, and said bottom member is provided with a recess for the passage of said scanning means for scanning said ribbon when said cassette is placed on said receiving means.

* * * * *